United States Patent [19]

Lutz et al.

[11] Patent Number: 4,604,186

[45] Date of Patent: Aug. 5, 1986

[54] PROCESS FOR UPGRADING RESIDUUMS BY COMBINED DONOR VISBREAKING AND COKING

[75] Inventors: Irvin H. Lutz; Thomas M. Wilson, both of Houston, Tex.

[73] Assignee: DM International Inc., Tulsa, Okla.

[21] Appl. No.: 795,713

[22] Filed: Nov. 6, 1985

Related U.S. Application Data

[63] Continuation of Ser. No. 617,502, Jun. 5, 1984, abandoned.

[51] Int. Cl.[4] ..... C10G 55/04

[52] U.S. Cl. ..... 208/50; 208/56; 208/131; 208/127

[58] Field of Search ..... 208/50, 56, 106, 131, 208/127

[56] References Cited

U.S. PATENT DOCUMENTS

| | | | |
|---|---|---|---|
| 2,500,757 | 3/1950 | Kiersted, Jr. | 196/13 |
| 2,873,245 | 2/1959 | Thompson et al. | 208/56 |
| 2,900,327 | 8/1959 | Beuther | 208/106 |
| 2,953,513 | 9/1960 | Langer, Jr. | 208/56 |
| 3,238,118 | 3/1966 | Arey et al. | 208/89 |
| 3,338,818 | 8/1967 | Paterson | 208/58 |
| 3,412,009 | 11/1968 | Smith et al. | 208/106 |
| 3,413,211 | 11/1968 | Becraft et al. | 208/93 |
| 3,891,538 | 6/1975 | Walkey | 208/50 |
| 3,907,664 | 9/1975 | Janssen et al. | 208/80 |
| 4,090,947 | 5/1978 | Satchell, Jr. | 208/56 |
| 4,176,046 | 11/1979 | McConaghy, Jr. | 208/50 |
| 4,178,229 | 12/1979 | McConaghy et al. | 208/50 |
| 4,213,846 | 7/1980 | Sooter et al. | 208/50 |
| 4,294,686 | 10/1981 | Fisher et al. | 208/56 |
| 4,347,120 | 8/1982 | Anderson et al. | 208/50 |
| 4,389,303 | 6/1983 | Simo et al. | 208/56 |
| 4,443,325 | 4/1984 | Chen et al. | 208/50 X |

FOREIGN PATENT DOCUMENTS 0032019 7/1981 European Pat. Off. .

OTHER PUBLICATIONS

Langer et al., Hydrogen Donor Diluent Visbreaking of Residua, I&EC Process Design and Development, vol. 1, No. 4, Oct. 1962, pp. 309–312.

*Primary Examiner*—Andrew H. Metz
*Assistant Examiner*—Glenn A. Caldarola
*Attorney, Agent, or Firm*—Bernard, Rothwell & Brown

[57] ABSTRACT

A process for upgrading petroleum residuums by hydrogen diluent donor visbreaking employs coking of a higher boiling fraction of the visbreaker effluent wherein the hydrogen donor is also supplied to the coker feed either by excess feed to the visbreaker or by mixing a portion with the coker feed. Controlling the quantity of hydrogen donor in the visbreaker and coker feed proportionally controls the quantity of coke produced.

28 Claims, 4 Drawing Figures

PROCESS FOR UPGRADING RESIDUUMS BY COMBINED DONOR VISBREAKING AND COKING

This is a continuation of application Ser. No. 617,502 filed June 5, 1984, now abandoned.

TECHNICAL FIELD

The invention relates to processes, such as hydrogen donor diluent visbreaking and coking processes, for upgrading residuums or heavy petroleum products.

DESCRIPTION OF THE PRIOR ART

The prior art, as exemplified in U.S. Pat. Nos. 2,873,245, 2,953,513, 3,238,118, 4,090,947, 4,294,686 and 4,389,303, contains many processes for upgrading heavy petroleum products or residuums to more valuable products by hydrogen donor diluent cracking, coking, etc. In hydrogen donor diluent cracking (HDDC), sometimes referred to as "donor visbreaking", the heavy hydrocarbon or residuum feed is mixed with a hydrogenated diluent or solvent and then passed to a visbreaker where heavy hydrocarbons are thermally converted under such conditions that hydrogen is transferred from the donor to the reactive fragments produced by thermal conversion. This hydrogen transfer prevents polymerization and condensation reactions which lead to coke formation. In conventional visbreaker processes, this tendency to coke limits the temperature and/or residence time in the furnace tubes and soaker drum, and thus limits the thermal conversion of the residuum to gas oil and lighter products.

The HDDC processes include processes wherein the donor, partially depleted of hydrogen by transfer of hydrogen to the reactive fragments of the residuum, is separated from the products, rehydrogenated and recycled to the visbreaker feed. Suitable donors are materials, aromatic-naphthenic in nature, which have the ability to take up hydrogen in a hydrogen zone and to readily release it to a hydrogen deficient oil in a thermal cracking zone. Hydrogen is transferred from naphthenes or other low order polycylic aromatics, i.e., materials with one or two aromatic rings, by conversion to higher order polycyclic aromatics, i.e., materials with two, three or more aromatic rings, and is taken up when the high order aromatics are rehydrogenated to convert back to low order aromatics for recycle. These high and low order aromatic materials are relatively stable and resistant to thermal cracking under process conditions. The prior hydrogen donors include: (1) relatively pure and expensive compounds such as naphthalene, tetralin, and anthracene, (2) materials of limited availability, such as high boiling, highly aromatic cuts from distilling the thermal tar produced by thermal cracking of catalytic cracking unit fractionator bottoms, and (3) donors produced by expensive processes such as solvent extraction. The relatively pure recycle donors are generally difficult to obtain, and since there is some unavoidable degradation to less valuable products, this results in high replenishment costs. The donors, obtained from crude or from visbreaking, generally contain a substantial amount of non-aromatic compounds which are not effective as hydrogen donors; such materials are costly to circulate through the process and dilute the reactants.

Coking processes, such as delayed coking and fluid coking, are sometimes utilized to convert residuums to coke plus lower boiling products suitable for further refining into gasoline and distillates of greater value than the residuum feed. Coking processes produce substantial quantities of coke which is a relatively low value byproduct.

In U.S. Pat. No. 4,090,947, there is suggested a visbreaker donor feed of a heavy gas oil output of a premium coker unit. The premium coker feedstock is thermal tar, decant oil from a fluid catalytic cracker, or other similar stream having comparable aromaticity and boiling range. In one embodiment, this patent teaches the passing of the gas oil recycle stream from a fractionator through the premium coker unit to remove components in the donor diluent recycle stream that might have a high propensity to form coke, thereby further reducing the amount of coke deposition in the cracking furnace. Generally, premium cokers require feeds of aromatic tar to produce needle coke which is in itself a valuable product, much more so than the coke produced from more common crude residuums. Such aromatic tars are not readily available in many areas.

SUMMARY OF THE INVENTION

The present invention is summarized in a process employing a unique combination of donor visbreaking and coking, such as delayed or fluid coking, wherein the higher boiling portion of the visbreaker effluent forms at least a portion of the coker feed and an aromatic gas oil fraction from the coker overhead forms the stream for donor hydrogenation and recycle to the visbreaker feed. It is found in the present process that the quantity of coke produced in the coker may be controlled by the hydrogen donor in the visbreaker feed.

An object of the invention is to reduce coke production in a coker by initially passing the residuum feed for the coker through hydrogen donor visbreaking.

Another object of the invention is to design a process employing donor visbreaker upgrading of petroleum residuums or heavy hydrocarbons utilizing a recycle donor stream wherein the aromatic concentration is increased by reactions in the coker.

Still another object of the invention is to utilize coking for removal of non-aromatic compounds from a donor visbreaking recycle stream while simultaneously controlling or limiting coke production.

One advantage of the invention is that a relatively less valuable coker product fraction boiling above the diesel range, i.e., above 700° F., may be utilized for donor recycle and extinction from product except for a possible small bleed stream.

A further advantage of the process is that by including the aromatic donor in the feed to the coker, the heat flux of the coker heating coil may be increased without coking in the coil.

One feature of the invention is the discovery that heavy gas oil fractions from fluid coking, particularly the materials boiling above 700° F., are very high in di-and multi-ring aromatics and are good hydrogen donor materials. This invention is particularly suited for processes using fluid coking, and processes for thermally converting heavy low hydrogen content materials such as Venezuelan resid, and heavy Canadian resids and tar sands. Fluid coking has been found to produce heavy gas oils with 80% by weight, or more, aromatic content.

Other objects, advantages and features of the invention will be apparent from the following description of the preferred embodiment taken in conjunction with the accompanying drawings.

DESCRIPTION OF THE PREFERRED EMBODIMENTS

Figure 1:
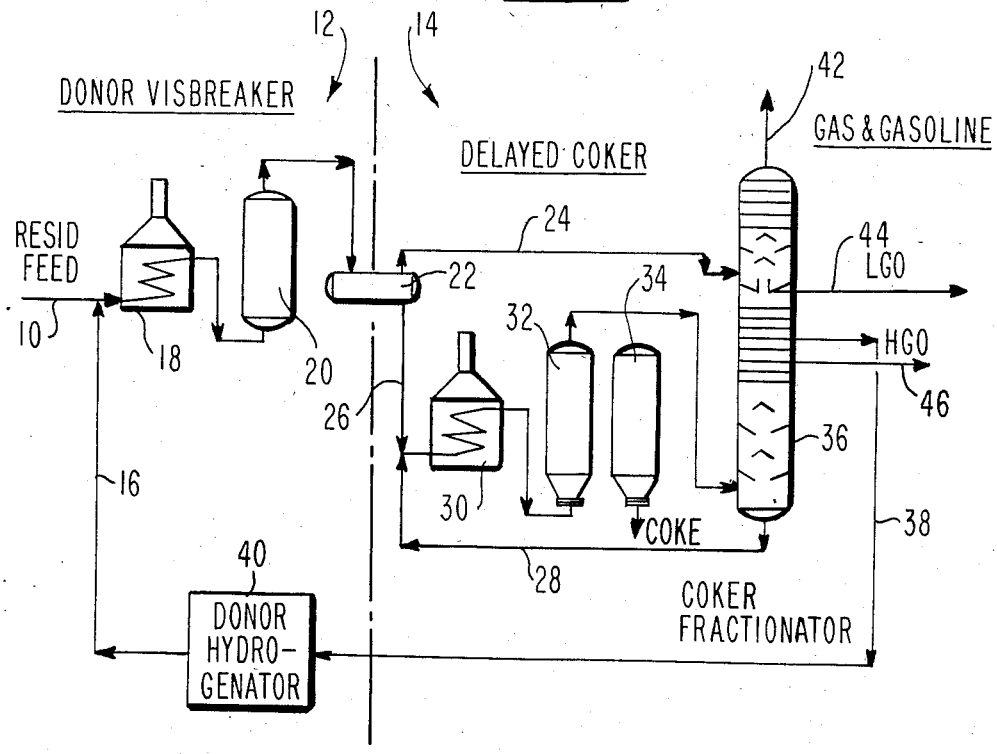
FIG. 1 is a flow diagram illustrating a process for upgrading residuums by combined donor visbreaking and coking in accordance with the invention.

As shown in FIG. 1, a system for upgrading residuum on input line 10 includes a donor visbreaker indicated generally at 12 and a coker indicated generally at 14 for receiving a high boiling point product from the visbreaker 12. The residuum feed in line 10 is mixed with a hydrogen donor diluent in line 16, and this mixture is fed to the visbreaker heater 18 which feeds the visbreaker soaking drum 20. The effluent from the drum 20 is passed to a flash vessel 22 where the low boiling portion is separated and passed to line 24 and the high boiling portion is passed to line 26. The high boiling portion in line 26 is mixed with a coker bottom recycle in line 28 which results from coker wash oil, and this mixture is passed through a coker heater 30 and then to one of the alternating coking drums 32 and 34. The vapor overhead product of the coking drums is fed to the lower section of a coker fractionating tower 36 which receives the low boiling constituent from line 24 in the upper section or above the total draw tray of the fractionator. A heavy gas oil product is recovered from the fractionator and passed by line 38 to a catalytic hydrogenator 40 where hydrogen is restored to the heavy gas oil product to produce the hydrogen donor diluent in line 16. Additionally, various lower boiling point products, such as gas and gasoline in line 42, and light gas oil in line 44 are withdrawn from the fractionator 36. A heavy gas oil bleed may be provided by line 46 to maintain the aromatics concentration and quantity of donor required. Recycling concentrates the aromatics since the portion of non-aromatics that are cracked on each pass through the system is substantially greater than the portion of aromatics that are cracked. The bottoms from the fractionator 36 form the coker bottoms recycle in line 28 where bottoms recycle is normal in cokers and represents the net wash stream.

In the visbreaker 12, the heater 18 heats the mixture of residuum and hydrogen donor to a temperature in the range of 800° F. to 980° F. (427° C. to 527° C.), preferably 830° F. to 900° F. (443° C. to 482° C.) before passing to the soaking drum 20. The drum 20 is designed to provide a sufficient reaction time to obtain a conversion of 10% or more of the feed, preferably 15 to 25% conversion, where conversion is expressed by volume percent $C_4$-430° F. (220° C.) gasoline on feed. The effluent from the drum 20 is flashed in vessel 22 to remove distillate boiling up to about 700° F. (370° C.) or more, preferably up to about 820° F. (440° C.). Hydrogen donor visbreaking is particularly found complementary to coking in that coke precursors or compounds which normally coke in a coker are converted in the hydrogen donor visbreaker to compounds which produce little or no coke in the coker to thus reduce the quantity of coke produced.

The heater 30 in the coker 14 heats the mixture of the recycle coker bottoms and the bottoms product from the flash vessel 22 to a temperature in the range of 900 to 980° F. (480°-527° C.), preferably 910° to 925° F. (485° to 495° C.), before passing the heated flow to the alternately cycled coking drums 32 and 34. The coking drums 32 and 34 are designed to bring about substantial cracking and coking for yielding coke and fluid products of light and heavy gas oils, gasoline, and gasses. The coker fractionator is designed to separate the heavy gas oil fraction which has a selected boiling range such as 820° to 900° F. (440° to 480° C.) or to a broader range such as 700° to 950° F. (370° to 510° C.) as well as other products which can be passed on to subsequent conventional processing stages for forming gasoline and other end products. The coker 14 has the advantage of concentrating the aromatic content of the donor cut; aliphatic and other less stable compounds within the same boiling range tend to crack to lower boiling products and are thus removed from the donor boiling range.

The boiling range of the donor cut in line 38 is preferably selected to produce sufficient donor feed in line 16 such that a portion of the hydrogenated donor is maintained in a hydrogenated state through the visbreaker system and into the coking operation where hydrogenated donor continues to transfer hydrogen to reactive fragments produced in the coker to reduce coke production. The presence of a substantial portion of hydrogenated donor in the feed through the coils of the coker furnace 30 reduces the tendency to form coke depositions therein and enables more rapid heating and higher temperatures which produce higher throughput and higher yield of light products. Generally, the hydrogenated donor is mixed with the residuum feed in a ratio from 0.2 to 2 weights per weight of residuum feed. Generally, minimum coke production is reached when from about 30 to 60% of the hydrogenated donor fraction passes unconverted through the visbreaker 12 into the coker 14. The ratio of the active hydrogenated donor to the fresh residuum feed to the visbreaker controls the quantity of coke generated in the coker. Thus, the coke yield may be controlled to produce more or less coke depending upon demand for coke product.

Figure 2:
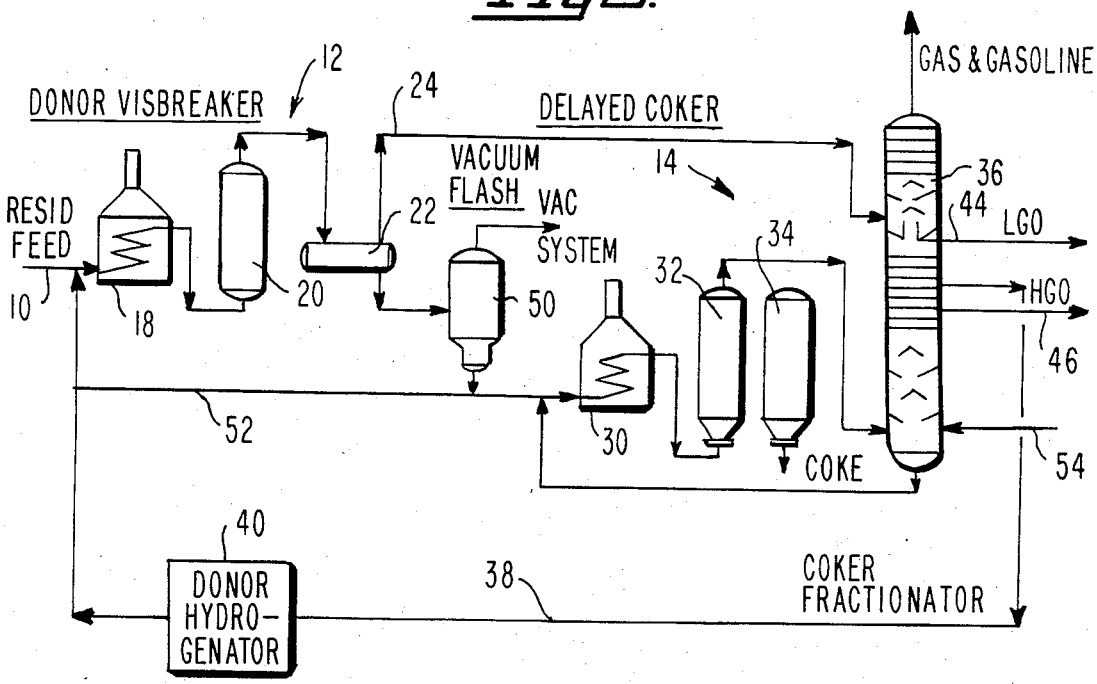
FIG. 2 is a flow diagram of a modified process for upgrading residuums by combined donor visbreaking and coking in accordance with the invention.

In the modified process illustrated in FIG. 2, the separating system for separating the effluent from the visbreaker 12 into high and low boiling fractions includes vacuum facilities 50 for operating the flash tower 22 under vacuum conditions. Additionally, the modified process illustrates line 52 for feeding hydrogenated heavy gas oil for direct mixing part of the donor with the high boiling fraction from the visbreaker for the feed to the coker 14. Thus, the hydrogen donor reaction occurs in both the coker and the visbreaker.

In areas where coal tar fractions or aromatic tars are available, including material in the donor boiling range, they may be added to the coker fractionator such as by line 54. With additional donor material added in this manner, the range of cut taken in line 38 may be reduced to thus increase the quantity of product which may be passed on to subsequent processing steps, such as catalytic cracking.

Figure 3:
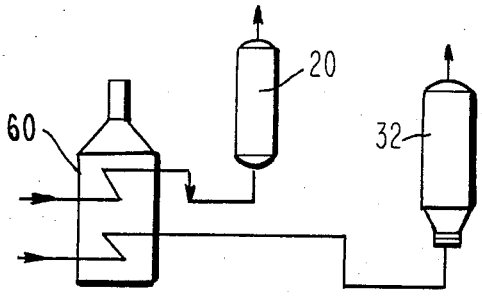
FIG. 3 is a flow diagram of a modified furnace arrangement which can be used in the processes of FIGS. 1 and 2.

As shown in FIG. 3, the furnaces 18 and 30 of FIGS. 1 and 2 may be replaced by a single furnace 60 having respective coils for heating the visbreaker and coker feeds. Conventional visbreaker and coker furnaces have two sections (not shown); the visbreaker resid feed is preheated in a first section to a temperature in the range of about 870° to 920° F. (465°-495° C.) before passing to the soaker 20. The flash 20 is made at a temperature in the range of about 770° to 830° F. (410°-445° C.). The bottoms of the flash would then be charged to the coker heating coil where the temperature in the range of about 910° C. to 950° F. (485°-510° C.) for feeding to the coker 32.

Figure 4:
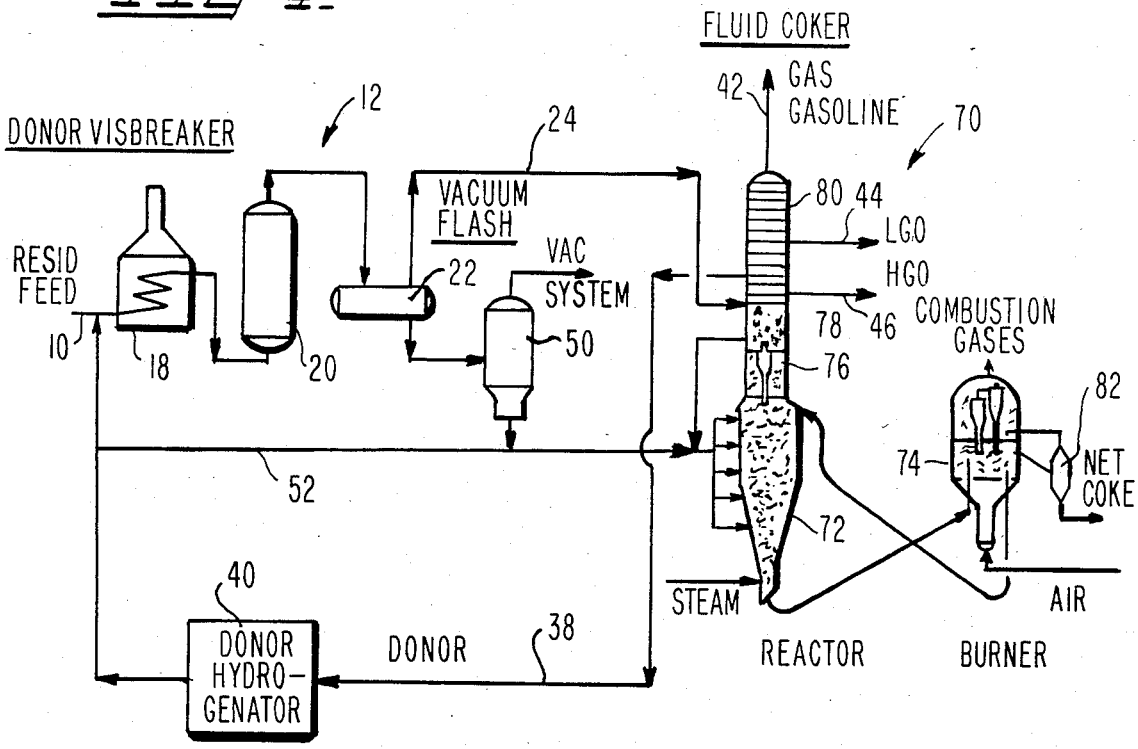
FIG. 4 is a flow diagram of a variation of the process of FIG. 2.

In FIG. 4, there is illustrated the employment of a fluid coker 70 in place of the delayed coker 14 of FIGS. 1 and 2. Coke particles are recycled through fluidized beds in reactors 72 and burner 74. Steam is introduced counter current to the flow of coke in the reactor 72 to cool the coke and control particle size. The high boiling portion of the visbreaker effluent is introduced into the fluid bed in the reactor. The vapor overhead product passes through a cyclone 76 and scrubber section 78 to remove fine coke particles prior to entering the fractionator section 80 where the products 38, 42, 44 and 46 are removed. The coke is heated in the burner 74 by partial combustion with air so as to produce a cut point of about 975° F. (525° C.) in the reactor 72. Coke product is drawn off the coke flow in the burner through an elutriator vessel 82. Burner combustion gases are cleaned by internally mounted cyclones, electrostatic precipitators for boiler stack gas, etc.

One of the possible modifications or extensions of the fluid coking 70 includes gasification of the coke in accordance with well known processes.

The heavy gas oil fractions from fluid coking of heavy low hydrogen content materials such as Venezuelan resids, and heavy Canadian resids and tar sands are found to have a high content, i.e., 80% or more by weight, of di- and multi-ring aromatics, which are good hydrogen donor materials and which, if recycled to extinction, do not greatly detract from the overall products produced. Use of this donor cut in the present process eliminates the need to import high aromatic donor material.

The presence of a substantial portion of hydrogenated donor in the feed to the fluid coker 70, along with previous removal of coke precursors in visbreaking, results in reduction of the quantity of coke product and an increase in the quantity of lighter products.

In some cases, it may be desirable to provide atmospheric and vacuum distillation of the donor visbreaker effluent instead of the utilization of the flash facilities 22. In this case, a donor cut may be taken either from the atmospheric or vacuum tower. Thus, a boiling range other than the heavy gas oil boiling range may be utilized for the donor. For example, a boiling range of 400° to 700° F. (200° to 307° C.) light gas oil may be utilized instead of the heavy gas oil. Alternatively, light cycle oil from a downstream catalytic cracking unit (not shown) may be used. It is preferred that the donor have a relatively high concentration of high order polycyclic aromatics such as about 60% by weight or more. The polycyclic aromatic compounds are converted into naphthenes or low order polycyclic aromatic compounds upon hydrogenation. These low order polycyclic aromatics readily convert back to higher order polycyclic aromatics under the conditions within the visbreaker and coker to release the hydrogen to the visbreaking and coking processes.

The present invention is ideally adapted for refineries which at present contain fluid or delayed coking units. The visbreaker 12 is merely added in front of the coker and the heavy gas oil fraction from the coker fractionator is hydrogenated and mixed with the feed to the visbreaker in sufficient excess quantity to pass to the coker to reduce the quantity of coke being produced.

Alternatively, the present process can be considered as a modification of prior art hydrogen diluent donor cracking processes wherein the prior art process is modified by inserting high boiling point separation and coking after visbreaking with the quantity of donor being increased sufficiently to produce sufficient donor concentration in the coking to reduce the quantity of coke being produced.

EXAMPLE

In an example of the process of the invention, Bachaquero residuum of 1.03 specific gravity and 20 Conradson carbon content is blended with hydrogenated donor in a ratio of two parts by weight residuum to one part by weight donor. This mixture is then charged to the donor visbreaker furnace operating at an outlet pressure of 400 PSIG (27.5 bar) and an outlet temperature of 860° F. (460° C.). The visbreaker furnace effluent is passed to a soaking drum designed to provide sufficient holding time to achieve 50% conversion of the feed to materials boiling under 900° F. (480° C.). The soaking drum effluent is flashed to produce a 820° F. (440° C.) cut point bottoms and distillate. The flashed vapors are sent to the fractionator above the total draw tray. The liquid boiling above 820° F. (440° C.) contains only 60% of the Conradson carbon content of the original Bachaquero feed. The high boiling fraction or flash bottoms, including about 50% of the original hydrogenated donor in its hydrogenated or unreacted state, is mixed with the coker bottoms fraction from the coker distiller. This mixture is heated in the coking furnance to an outlet temperature of 930° F. (500° C.) and then sent to the coking drum presently connected in the process cycle. The fluid product or effluent from the coke drum is sent to the bottom section of the main coke fractionator where the donor cut boiling in the range from 820° to 920° F. (440° to 490° C.) is obtained, along with a vapor containing all compounds boiling below about 820° F. (440° C.) and a liquid fraction or coker bottoms recycle boiling above about 920° F. (490° C.). Other streams may be withdrawn from the fractionator, such as a 920°-950° F. (490° to 570° C.) cut. The coke yield, expressed in weight percent on original Bachaquero feed is 16% compared to 26% for the case where the Bachaquero feed is not first charged to the donor visbreaking unit and there is an absence of hydrogen donor in the coking feed.

Since many modifications, variations and changes in detail may be made to the above-described embodiments, it is intended that all matter in the foregoing description and shown in the accompanying drawings be interpreted as illustrative and not in a limiting sense.

What is claimed is:

1. A process for upgrading petroleum residuums to more valuable products comprising the steps of mixing a hydrogenated aromatic donor fraction with the petroleum residuums to form a vis breaker feed;

donor visbreaking the visbreaker feed in a thermal visbreaker to crank heavy hydrocarbons into lighter products wherein the hydrogenated fraction in the visbreaker feed reacts to donate hydrogen to prevent formation of coke and reduce the quantity of coke precursors;

coking a coker feed including substantially all of the high boiling portion and substantially all of the aromatic donor fraction of the effluent from the visbreaker in a coker under nonpremium coker conditions to produce coke and overhead products whereby the reduction of coke precursors by the donor visbreaking reduces the quantity of coke product and increases the quantity of overhead productd;

fractionating the overhead products from the coker in a fractionater to produce one or more light product fractions, and an aromatic donor recycle fraction; and hydrogenating the aromatic donor recycle fraction from the fractionator to form the hydrogenated donor formation for the visbreaker feed.

2. A process as claimed in claim 1 wherein hydrogenated donor material is included in the coker feed such that the hydrogenated donor material transfers hydrogen to reactive fragments produced during coking to reduce the quantity of coke product and increase the quantity of overhead products.

3. A process as claimed in claim 2 wherein the hydrogenated donor fraction in the visbreaker feed is selected large enough to supply the hydrogenated donor material in the coker feed.

4. A process as claimed in claim 3 wherein a percentage in the range from 30 to 60 percent of the hydrogenated donor fraction passes unreacted through the visbreaker to the coker feed.

5. A process as claimed in claim 1 including the step of separating the effluent from the visbreaker into high and low boiling fractions and the separated high boiling fraction is included in the coker feed.

6. A process as claimed in claim 5 wherein the separated low boiling fraction from the visbreaker effluent is also fed to the fractionator.

7. A process as claimed in claim 5 wherein the separating is performed by flashing the effluent from the visbreaker.

8. A process for upgrading petroleum residuums to more valuable products comprising the steps of mixing a hydrogenated aromatic heavy gas oil fraction with the petroleum residuums to form a visbreaker feed;

visbreaking the visbreaker feed in a thermal visbreaker to crack heavy hydrocarbons into lighter products wherein a portion of the hydrogenated aromatic heavy gas oil fraction reacts to donate hydrogen to prevent formation of coke while leaving a substantial unreacted portion of the hydrogenated fraction in the effluent from the visbreaker;

separating the effluent from the visbreaker into high and low boiling fractions wherein the high boiling fraction includes substantially all of the reacted and unreacted portions of the hydrogenated aromatic heavy gas oil fraction along with substantially all of the high boiling portion of the visbreaker effluent;

coking the high-boiling fraction in a coker under nonpremium coking conditions to produce coke and overhead products wherein the unreacted portion of the hydrogenated aromatic heavy gas oil reacts to donate hydrogen to reduce the quantity of coke product and to increase the quantity of overhead products;

fractionating the overhead products from the coker in a fractionator to produce one or more light product fraction, an aromatic heavy gas oil fraction, and the coker bottoms fraction for the above coker feed mixing: and hydrogenating the aromatic heavy gas oil fraction from the fractionator to form the hydrogenated aromatic heavy gas oil fraction for the above visbreaker feed mixing.

9. A process as claimed in claim 8 wherein the heavy gas oil fraction from the fractionator has a boiling range within the range from about 370° to 510° C., the visbreaking is performed at a temperature in the range from about 427° to 527° C., the high boiling fraction is separated from the visbreaker effluent to remove distillate boiling up to about 370° C. in the low boiling fraction, and the coking is performed at a temperature in the range from about 480° to 527° C.

10. A process as claimed in claim 8 wherein the hydrogenated heavy gas oil fraction is mixed with the residuum in a ratio of from 0.2 to 2 weights of hydrogenated heavy gas oil fraction per weight of residuum.

11. A process as claimed in claim 9 wherein the visbreaking is performed at a temperature in the range from 443° to 482° C., the high boiling fraction is separated from the visbreaker effluent to remove distillate boiling up to about 440° C., and the coking is performed at a temperature in the range from about 488° to 496° C.

12. A process as claimed in claim 9 wherein the visbreaking is performed over a reaction time sufficient to obtain a conversion of 10% or more of feed to $C_4$-220° C. gasoline.

13. A process as claimed in claim 8 wherein the separated low boiling fraction from the visbreaker effluent is fed to the fractionator.

14. A process as claimed in claim 8 wherein the separating is performed by flashing the effluent from the visbreaker.

15. A process as claimed in claim 8 wherein the separating is performed by distilling the effluent from the visbreaker.

16. A process as claimed in claim 4 wherein the coking is performed by fluid coking.

17. In a process for upgrading petroleum residuums to more valuable products wherein a residuum feed is mixed with a coker bottoms recycle to form a coker feed, the coker feed is coked in a coker under nonpremium coker conditions to produce coke and fluid products, and the fluid products are fractionated in a fractionator to produce the coker bottoms recycle and lighter products; the improvement comprising hydrogenating an aromatic heavy gas oil fraction from the fractionator; mixing the hydrogenated aromatic heavy gas oil fraction with residuums to form a visbreaker feed, visbreaking the visbreaker feed in a thermal visbreaker to crack heavy hydrocarbons into lighter products wherein a portion of the hydrogenated aromatic heavy gas oil reacts to donate hydrogen to minimize formation of coke and reduce the quantity of coke precursors while leaving a substantial unreacted portion of the hydrogenated heavy gas oil fraction in the effluent from the visbreaker, separating the effluent from the visbreaker into high and low boiling fractions wherein the high boiling fraction forms the coker feed and includes substantially all of the unreacted portion of the hydrogenated aromatic heavy gas oil fraction and uncracked reacted heavy gas oil along with substantially all of the high boiling portion of the visbreaker effluent and whereby the unreacted portion of the hydrogenated aromatic heavy gas oil fraction in the coker feed reacts to donate hydrogen to reduce the quantity of coke produced in the coker and increase the quantity of fluid products.

18. The improvement as claimed in claim 17 wherein the heavy gas oil fraction fromthe fractionator has a boiling range within the range from the about 370° to 510° C., the visbreaking is performed at a temperature in the range from about 427° to 527° C., the high boiling fraction is separated from the visbreaker effluent to remove distillate boiling up to about 370° C. in the low boiling fraction, and the coking is performed at a temperature in the range from about 400° to 527° C.

19. The improvement as claimed in claim 17 wherein the hydrogenated heavy gas oil fraction is mixed with the residuum in a ratio of from 0.2 to 2 weights of hydrogenated heavy gas oil fraction per weight of residuum.

20. The improvement as claimed in claim 17 wherein the separated low boiling fraction from the visbreaker effluent is fed to the fractionator.

21. The improvement as claimed in claim 17 wherein the separating is performed by flashing the effluent from the visbreaker.

22. The improvement as claimed in claim 17 wherein the separating is performed by distilling the effluent from the visbreaker.

23. In a hydrogen donor diluent cracking process wherein residuums are mixed with an aromatic hydrogenated heavy gas oil fraction to form a visbreaker feed, the visbreaker feed is thermally cracked in a visbreaker such that hydrogenated aromatic gas oil reacts to donate hydrogen to minimize formation of coke in the visbreaker and reduce the quantity of coke precursors, a fractionator feed from the visbreaker is fractionated in a fractionator to produce an aromatic heavy gas oil fraction and lighter products, and the aromatic heavy gas oil fraction is hydrogenated to form the hydrogenated aromatic heavy gas oil fraction for mixing with the residuums; the improvement comprising selecting the heavy gas oil fraction from the fractionator to produce sufficient hydrogenated aromatic heavy gas oil to leave a substantial unreacted portion of the hydrogenated aromatic gas oil fraction in the effluent from the visbreaker; separating the effluent from the visbreaker into high and low boiling fractions wherein the high boiling fraction includes substantially all of the high boiling portion of the visbreaker effluent and substantially all of the unreacted portion of the hydrogenated aromatic heavy gas oil fraction and uncracked reacted aromatic heavy gas oil, mixing the high boiling fraction with a coker bottoms fraction from the fractionator to form a coker feed, and coking the coker feed in a coker under nonpremium coker conditions to produce coke and fluid products which form at least a portion of the fractionator feed.

24. The improvement as claimed in claim 23 wherein the heavy gas oil fraction from the fractionator has a boiling range within the range from about 370° to 510° C., the visbreaking is performed at a temperature in the range from about 427° to 527° C., the high boiling fraction is separated from the visbreaker effluent to remove distillate boiling up to about 370° C. in the low boiling fraction, and the coking is performed at a temperature in the range from about 400° to 527° C.

25. The improvement as claimed in claim 23 wherein the hydrogenated heavy gas oil fraction is mixed with the residuum in a ratio of from 0.2 to 2 weights of hydrogenated heavy gas oil fraction per weight of residuum.

26. The improvement as claimed in claim 23 wherein the separated low boiling fraction from the visbreaker effluent is fed to the fractionator.

27. The improvement as claimed in claim 23 wherein the separating is performed by flashing the effluent from the visbreaker.

28. The improvement as claimed in claim 23 wherein the separating is performed by distilling the effluent from the visbreaker.

* * * * *